United States Patent [19]

Diesner et al.

[11] Patent Number: 5,031,336

[45] Date of Patent: Jul. 16, 1991

[54] LYOPHILIZATION OF BULK PHARMACEUTICALS

[75] Inventors: Curt L. Diesner, Waukegan; Anthony J. Hlinak, Lindenhurst; Douglas W. Mendenhall, Libertyville, all of Ill.

[73] Assignee: Abbott Laboratories, Abbott Park, Ill.

[21] Appl. No.: 417,958

[22] Filed: Oct. 4, 1989

Related U.S. Application Data

[63] Continuation-in-part of Ser. No. 402,102, Aug. 31, 1989, abandoned.

[51] Int. Cl.[5] ..... F26B 5/06

[52] U.S. Cl. ..... 34/5; 34/15

[58] Field of Search ..... 34/5, 92, 15, 17

[56] References Cited

U.S. PATENT DOCUMENTS 4,802,286 2/1989 Kobayashi et al. ..... 34/15

*Primary Examiner*—Henry A. Bennet

*Attorney, Agent, or Firm*—Jerry F. Janssen; Steven F. Weinstock

[57] ABSTRACT

A process for lyophilizing bulk solutions of products in which liquid product is poured into bottomless trays, frozen and dried.

7 Claims, 2 Drawing Sheets

LYOPHILIZATION OF BULK PHARMACEUTICALS

This is a continuation-in-part of U.S. Pat. application Ser. No. 402,102, filed Aug. 31, 1989 now abandoned.

TECHNICAL FIELD

This invention relates to the lyophilization of bulk solutions of sterile powdered products such as pharmaceutical, nutritional and diagnostic products.

BACKGROUND OF THE INVENTION

Lyophilization or freeze drying techniques have been used to prepare powdered pharmaceuticals and other products under sterile conditions Most lyophilization techniques are time comsuming or yield incompletely dried product. Accordingly, it is an object of the present invention to reduce production costs by reducing the drying time and improving the product quality of lyophilized bulk sterile powdered pharmaceutical, nutritional and diagnostic products.

SUMMARY OF THE INVENTION

The present invention relates to a process for lyophilizing bulk solutions of pharmaceutical, nutritional and diagnostic products.

More particularly, the present invention relates to a process for lyophilizing bulk solutions of products such as pharmaceutical, nutritional and diagnostic products in which bulk solutions of such products are poured into bottomless forms that are in a liquid tight seal relationship with a lyophilizer shelf, freezing the liquid and drying the frozen liquid directly on the lyophilizer shelf to form a powder. After drying, the powder can be recovered using a sterile vacuum system. The recovered powder can be sent directly to a fill line, thus eliminating the milling step.

The process of the present invention reduces drying time, eliminates the need for milling and reduces the amount of container washing and handling required.

BRIEF DESCRIPTION OF THE DRAWINGS

The present invention will best be understood by reference to the following specification and claims taken in conjunction with the accompanying drawings in which:

DETAILED DESCRIPTION OF THE PREFERRED EMBODIMENTS

Figure 1:
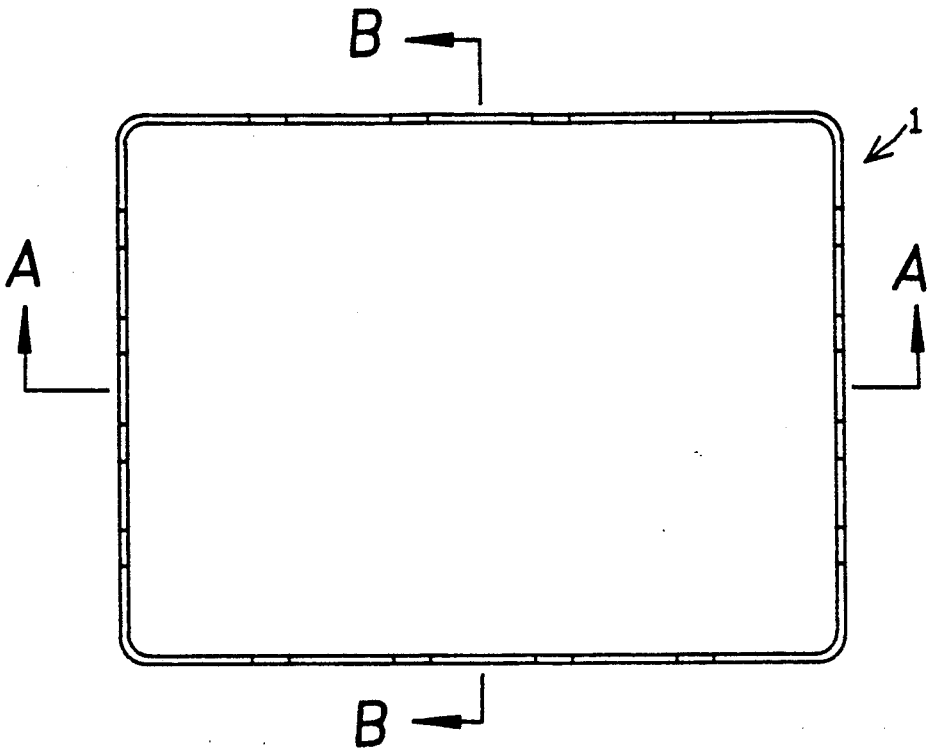
FIG. 1 is a horizontal section of a bottomless drying form of the present invention.

While the present invention is susceptible of embodiment in many forms, there is shown in the drawings and will hereinafter be described, a presently preferred embodiment with the understanding that the present specification is to be considered as an exemplification of the invention, and is not intended to limit the invention to the specific embodiments illustrated.

Referring to the drawings, FIG. 1 is a horizontal section of a bottomless drying form 1 that is generally rectangular in shape and is sized to fit on the shelves of a lyophilizer (not shown). The form 1 is constructed of stainless steel and has generally rounded corners. The form 1 also has a gasket along its lower edge to seal the liquid product inside the form until it is frozen. The gasket can be constructed of polyethylene, propylene or another suitable material. A liquid tight seal relationship can be obtained by collapsing the shelves of a lyophilizer by activating its hydraulic stoppering system. In use, the shelves of the lyophilizer are generally prechilled to about −40° C. and the solution fed at a rate that allows the solution to freeze on contact.

Figure 2:
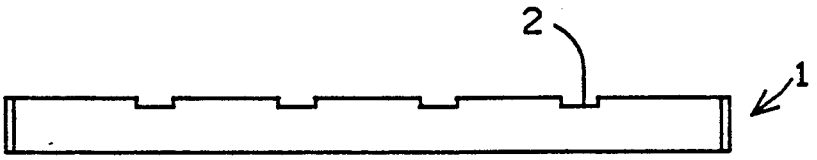
FIG. 2 is a vertical section along the line AA of the bottomless drying form of FIG. 1.

FIG. 2 is a vertical section along the line AA of the bottomless drying form 1 of FIG. 1 and illustrates vent holes 2 that are present in order to allow water vapor generated during the drying process to escape.

Figure 3:
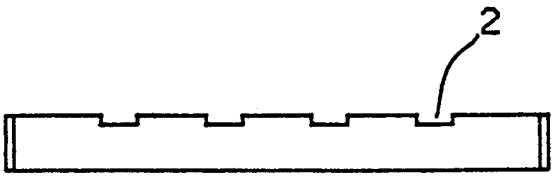
FIG. 3 is a vertical section along the line BB of the bottomless drying form of FIG. 1.

FIG. 3 is a vertical section along the line BB of the bottomless drying form of FIG. 1 and illustrates vent holes 2.

Figure 4:
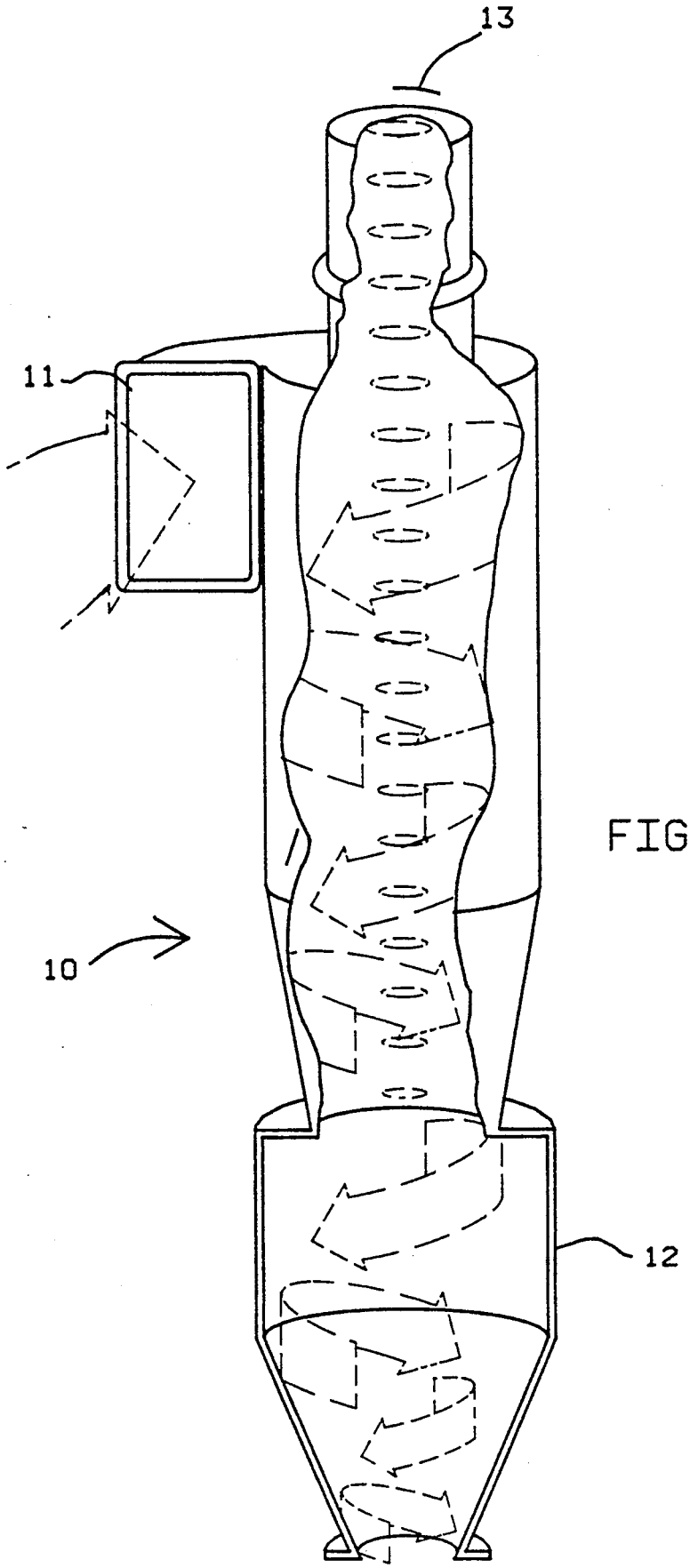
FIG. 4 is a schematic of a cyclone utilized in the process of the present invention.

FIG. 4 is a schematic of a cyclone 10 utilized in the sterile vacuum recovery system in the practice of the present invention. The dried product is vacuumed off each shelf and enters the cyclone tangentially entrained in an air stream at inlet duct 11. The product is thrown by centrifugal force to the inside walls and drops to a receiver 12 due to the relatively low air velocity in the vicinity of the wall and the force of gravity. The air stream, without product, continues out the top 13 of the cyclone. A Fisher-Klosterman Model XQ120-1.5 cyclone available from Fisher-Klosterman, Inc., Louisville, KY or equivalent cyclone can be utilized in the practice of the present invention. Transfer hoses (not shown) can be made of reinforced silicone rubber.

The process of the present invention can be used to lyophilize a wide range of products. For example, pharmaceutical products, such as antibiotics, infant, adult and sports nutritional products such as Isomil®, Ensure® and Exceed® and diagnostic products, such as controls for cancer diagnostics, may be prepared by the process of the present invention. Shortened drying times and improved product quality are obtained by the elimination of the variable barrier to heat transfer caused by the tray bottoms. This allows the heat to flow directly to the product from the shelf.

Standard lyophilization conditions, as for example those disclosed in "Freeze Drying of Pharmaceuticals" (DeLuca, Patrick P., J. Vac. Sci. Technol., Vol. 14, No. 1, Jan./Feb. 1977) or "The Lyophilization of Pharmaceuticals: A Literature Review" (Williams, N. A., and G. P. Polli, Journal of Parenteral Science and Technology, Vol. 38, No. 2, March/April 1984) are utilized.

The following representative examples will illustrate the process of the present invention.

EXAMPLE 1

A sterile solution of 11% by weight erythromycin lactobionate was prepared. Sterilized drying forms with attached silicone rubber gaskets are placed on each shelf of a lyophilization chamber and the shelf assembly collapsed using the lyophilizer's hydraulic stoppering system to form a liquid tight seal between the gasket edge of each form and the shelf. The solution is fed through a sterilizing filter into the forms to create a liquid pool approximately 2.1 cm. in height. The product is frozen to a temperature of less than about −35° C. and held for a minimum of two hours to assure complete freezing. The product is then dried in three stages under full vacuum by raising the shelf temperature to −5° C. and holding for 32 hours, raising the shelf temperature to +20° C. and holding for 12 hours, and raising the shelf temperature to +40° C. and holding 12 hours. The vacuum is then released with filtered room air and the vacuum dried material is removed from the shelves through a silicone rubber collection hose using the cyclone operating at an air rate of approximately 25 actual cubic feet per hour and fed into plastic bags. The finely divided material is filled without further milling into vials.

EXAMPLE 2

A sterile solution of 15% by weight mannitol was prepared. Sterilized, non-gasketed drying forms are placed on each shelf and the shelf assembly collapsed using the lyophilizer's hydraulic stoppering system. The shelves and drying forms are prechilled to a temperature below −40° C. The solution is fed through a sterilizing filter into the forms at a rate that allows the solution to freeze on contact and form a liquid tight seal between the edge of each form and the shelf. Once the frozen layer is established, the solution is further fed into the forms as a liquid layer developes on top of the previously established frozen layer, to a total height of approximately 2.1 cm. The product is held for an additional two hours to assure complete freezing. The product is then dried in three stages under full vacuum by raising the shelf temperature to −5° C. and holding for 32 hours, raising the shelf temperature to +20° C. and holding for 12 hours, and raising the shelf temperature to +40° C. and holding for 12 hours. The vacuum is then released with filtered room air and the vacuum-dried material is removed from the shelves through a convoluted 316 stainless steel collection hose using the cyclone operating at an air rate of approximately 25 actual cubic feet per hour and fed into plastic bags. The finely divided material is filled without further milling into vials.

EXAMPLE 3

A solution of 12–16% by weight of Similac ® can be prepared. Drying forms with attached ethylene propylene rubber gaskets are placed on each shelf of a lyophilization chamber and the shelf assembly collapsed using the lyophilizer's hydraulic stoppering system to form a liquid tight seal between the gasket edge of each form and the shelf. The solution can be fed through a sterilizing filter into the forms to create a liquid pool approximately 2.1 cm. in height. The product can be frozen to a temperature of less than about −30° C. and held for a minimum of two hours to assure complete freezing. The product is then dried in four stages at a pressure below 400 microns Hg. absolute by raising the shelf temperature to −10° C. and holding for 30 hours, raising the shelf temperature to +10° C. and holding for 10 hours, raising the shelf temperature to +20° C. and holding for 10 hours, and raising the shelf temperature to +40° C. and holding for 6 hours. The vacuum is then released with filtered room air and the vacuum-dried material is removed from the shelves through a polyisoprene collection hose using the cyclone operating at an air rate of approximately 25 actual cubic feet per hour and fed into plastic bags. The finely divided material is filled without further milling into product containers.

We claim:

1. A process for lyophilizing bulk solutions of powdered products comprising the steps of pouring a solution of such a product into a bottomless form that is in a liquid tight seal relationship with a shelf of a lyophilization chamber having a hydraulic stoppering system, freezing the solution, and drying the frozen solution directly on the shelf to form a lyophilized powder.

2. A process as in claim 1 that comprises the additional step of recovering the lyophilized powder by vacuuming the powder.

3. A process as in claim 1 where the liquid tight seal relationship is obtained by placing gasketed bottomless forms on each shelf of a lyophilization chamber and collapsing the shelves using the lyophilizer's hydraulic stoppering system.

4. A process as in claim 1 where the liquid tight seal relationship is obtained by placing ungasketed drying forms on each shelf and collapsing the shelf assembly using the lyophilizer's hydraulic stoppering system, prechilling the shelves and drying forms to a temperature below −40° C., and then feeding the solution into the forms at a rate that allows the solution to freeze on contact.

5. A process as in claim 1 wherein the solution to be dried is a pharmaceutical product.

6. A process as in claim 1 where the solution to be dried is a nutritional product.

7. A process as in claim 1 where the solution to be dried is a diagnostic reagent.

* * * * *